US012453444B1

(12) United States Patent
Scalf

(10) Patent No.: US 12,453,444 B1
(45) Date of Patent: Oct. 28, 2025

(54) HIDDEN STORAGE WITH A FOLDING TOWEL ROD

(71) Applicant: Trina Scalf, Inglis, FL (US)

(72) Inventor: Trina Scalf, Inglis, FL (US)

( * ) Notice: Subject to any disclaimer, the term of this patent is extended or adjusted under 35 U.S.C. 154(b) by 97 days.

(21) Appl. No.: 18/506,674

(22) Filed: Nov. 10, 2023

Related U.S. Application Data

(60) Provisional application No. 63/449,153, filed on Mar. 1, 2023.

(51) Int. Cl.
*A47K 10/10* (2006.01)
*B65D 25/20* (2006.01)
*B65D 43/14* (2006.01)

(52) U.S. Cl.
CPC ..... *A47K 10/10* (2013.01); *B65D 25/20* (2013.01); *B65D 43/14* (2013.01); *B65D 2543/00194* (2013.01)

(58) Field of Classification Search
CPC ..... A47K 10/10; B65D 25/20; B65D 43/14; B65D 2543/00194; D06F 57/12; A47B 61/02; A47B 77/10
See application file for complete search history.

(56) References Cited

U.S. PATENT DOCUMENTS 1,724,218 A * 8/1929 Nixon ..... A47B 61/02 211/98
2,885,086 A * 5/1959 Lawrence ..... A47K 10/10 312/310
3,925,127 A * 12/1975 Yoshioka ..... B32B 37/0084 156/445
4,434,897 A * 3/1984 Gelhaus ..... D06F 57/12 211/33
2006/0220502 A1* 10/2006 Williams ..... A47B 61/02 312/108

FOREIGN PATENT DOCUMENTS

| | | | |
|---|---|---|---|
| CN | 105534366 | A | 5/2016 |
| CN | 206239300 | U | 6/2017 |
| CN | 210114376 | U | 2/2020 |
| CN | 211270432 | U | 8/2020 |
| CN | 211609558 | U | 10/2020 |
| CN | 214342024 | U | 10/2021 |
| CN | 216317297 | U | 4/2022 |

* cited by examiner

*Primary Examiner* — Shawn M Braden
(74) *Attorney, Agent, or Firm* — John Rizvi; John Rizvi, P.A.—The Patent Professor®

(57) ABSTRACT

A storage box assembly is provided including a rear portion separated from a front portion by a door configured to be manually opened. Items may be stored in the rear portion in any of one or more compartments and one or more shelves. The front portion includes one or more rods attached to one or more hinges configured rotate the one or more rods out of the front portion for items to be hung from the rods. The storage box assembly is designed to be built into a wall. When not needed, the one or more rods may be rotated back into the front portion to allow for open space in front of the storage box assembly.

21 Claims, 7 Drawing Sheets

HIDDEN STORAGE WITH A FOLDING TOWEL ROD

CROSS-REFERENCE TO RELATED APPLICATION

This application claims the benefit of U.S. Provisional Patent Application No. 63/449,153, filed on Mar. 1, 2023, which is incorporated herein by reference in its entirety.

FIELD OF THE INVENTION

The present invention relates generally to storage boxes, and more particularly, to a box assembly having an open face, a storage area, and an in-set towel rod attached to a hinge mounted to one or more sides of the storage box allowing the in-set towel rod to be folded out in an angular direction onto which a towel can be hung.

BACKGROUND OF THE INVENTION

Storage boxes are used to contain one or more items generally for a related purpose. Storage boxes generally comprise a polygonal box structure, which may be placed in a room or fixed externally to a structure of the room, such as a wall, floor, or ceiling.

It is useful for a storage box to be fixed internally to a structure of a room such as a wall, floor, or ceiling to save space. Fixation internal to a structure of a room allows for the storage box to be out of the way when one or more items stored within are not needed and another item or other items do not need to be placed in the storage box. Fixation internal to a structure of a room is particularly useful for small rooms.

It is functional for a storage box to have one or more built-in accessories for use with one or more items within or just outside the box. The one or more built-in accessories may be used with items not intended for storage within the box per se, but have one or more purposes related to purposes of items stored within the box.

It is additionally useful for a storage box to have any of one or more shelves and one or more compartments for storage of items throughout all or part of the volume of the storage box. The any of one or more shelves and one or more compartments may each be arranged for storage of items used for closely related purpose, for use by only one or a small number of users, or of a similar size.

It is further functional for a storage box to have one or more doors within one or more portions of volume of the storage box. The one or more doors may better physically secure and hide one or more items behind the one or more doors. Thus, the one or more doors may maintain confidentiality of the one or more kinds of one or more items behind the one or more doors from one or more individuals entering a room, where the storage box is located, but not intended to know about or to use any of the one or more items behind the one or more doors. Thus, privacy of one or more users of any of the one or more items behind the one or more doors may be ensured. Physical security, confidentiality, and privacy may be enhanced if the one or more doors may be locked and capable of being unlocked by the one or more users.

Accordingly, there is a need for a solution to at least one of the aforementioned problems.

SUMMARY OF THE INVENTION

The present invention is directed to a storage box assembly to contain one or more items comprising two or more sides and a rear surface. The storage box assembly may be fabricated out of wood, fiberglass, plastic, metal or other solid, machinable material. The storage box assembly is configured to be built into a wall of a room such that a width of the storage box assembly is no greater than a space between adjacent studs in the wall in between which the storage box assembly is installed. The storage box assembly includes a door configured to close off a rear portion of an interior volume of the storage box assembly. A remaining portion of the interior volume of the storage box assembly includes one or more rods which may be pivoted inward or outward of the storage box assembly.

In a first implementation of the invention, the storage box assembly is built into the wall with the front of the storage box assembly in the plane of the surface of the wall. The door is closed and the one or more rods are set at a lowered position such that the one or more rods are in the plane of the wall. The one or more rods extend, at lowest, from the hinge to just above the bottom of the storage box assembly. The door includes a knob, located near a side of the door opposing the side of the door attached to the one or more door hinges, for an individual to open the door manually.

In a second aspect, the rear portion of the interior volume of the storage box assembly behind the door may include one or more shelves to store items.

In another aspect, the one or more rods are raised upward along a lateral (pitch) angular direction to make a perpendicular angle with the wall. The one or more rods may be used for hanging towels, other bath linens, or garments. The door is opened sideways along an axial (yaw) angular direction to make a perpendicular angle with the wall.

In another aspect, the rods have different lengths. The rods are attached to the hinge at a side of the storage box assembly opposite to the side of the storage box assembly to which the one or more door hinges are attached. The hinge is connected to the top of the front portion and bottom of the storage box assembly. The rods are configured to be rotated separately at an axial (yaw) angular direction opposite to the angular direction of the opening of the door. The rods may be set at different axial (yaw) angular positions.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a storage box assembly built into a wall configured to contain one or more items in a rear portion of an interior volume of the storage box assembly behind a door with a remaining portion of the interior volume of the storage box assembly configured to include one or more rods attached to a hinge configured to be angularly adjusted outside of the box.

Figure 1:
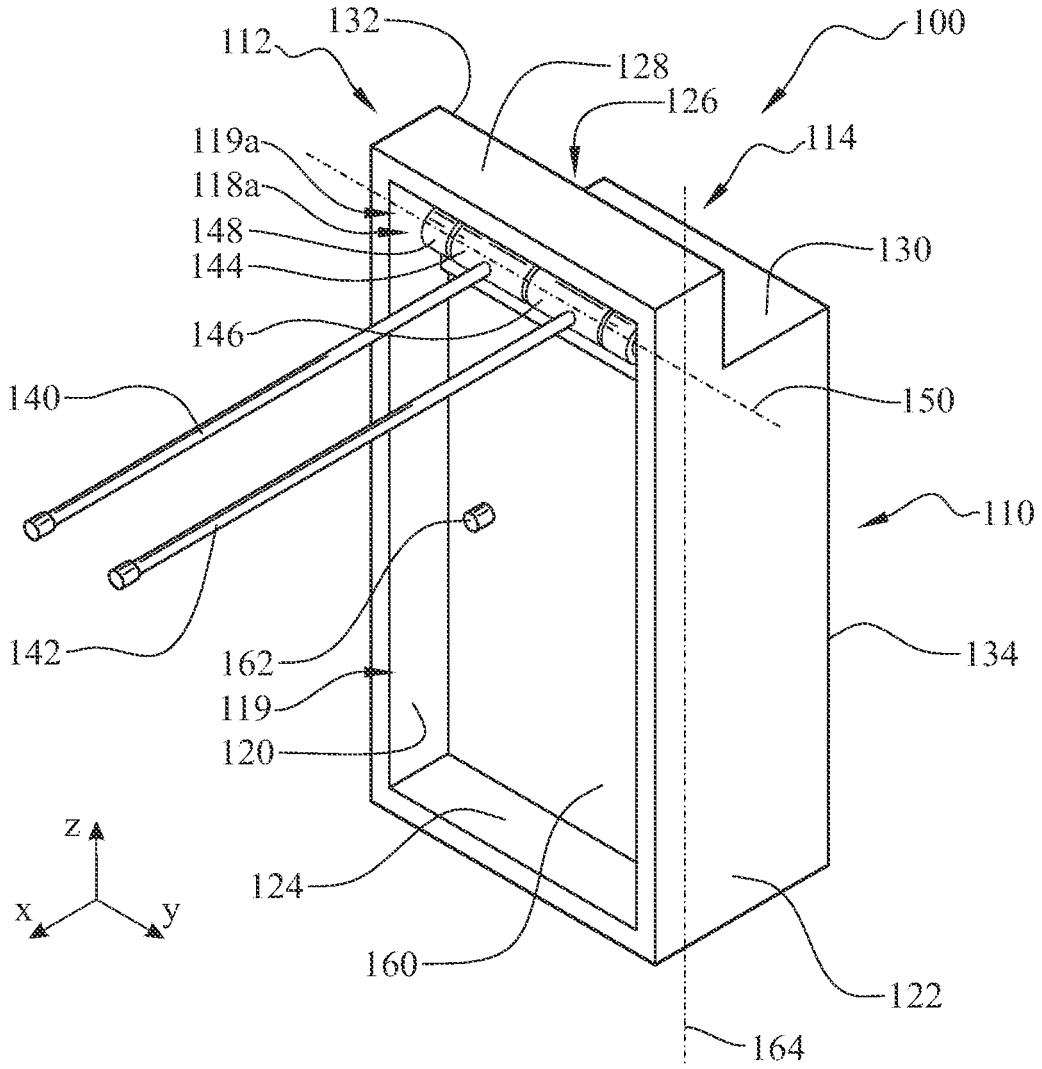
FIG. 1 presents a top, front right side isometric view of a storage box assembly in accordance with a first illustrative embodiment of the present invention, with rods of the storage box assembly shown in a raised, extended position.

Referring initially to FIG. 1, there is shown an isometric view of a storage box assembly 100. The storage box assembly 100 includes a main body 110, which may be three-dimensionally formed along a front-to-back or longitudinal axis x, a left-to-right or transverse axis y, and a vertical axis z, wherein said axes x, y, z are perpendicular to one another and form an orthogonal axis set. It should be further noted that, as known, lines which are parallel in reality (i.e. a three-dimensional space) appear parallel in a two-dimensional, isometric drawing such as the isometric drawings included herein. The main body 110 of the storage box assembly 100 may include a front portion 112 and a rear portion 114, which may extend rearward from the front portion 112. The main body 110 may be generally hollow and define an interior space 116. The main body 110 may end in a front opening 119, arranged frontward of and providing access to the interior space 116. The main body 110 may include two or more lateral sides or side walls, such as a left side wall 120 and a right side wall 122. The left and right side walls 120 and 122 may be planar, parallel to one another, and arranged vertically and longitudinally (i.e. in an x-z plane), as shown. The main body 110 may further include a bottom wall 124, which may extend between the left and right side walls 120 and 122. The bottom wall 124 may be planar and generally horizontal, i.e. arranged in an x-y plane, thus perpendicularly to the left and right side walls 120 and 122. The main body 110 may further include a top wall 126, which may be defined or divided into a front top wall 128 (or top wall of the front portion 112), a rear top wall 130 (or top wall of the rear portion 114), and a transition wall 132 extending between the front top wall 128 and the rear top wall 130. The transition wall 132 may constitute a rear side of the front portion 112 of the main body 110. The transition wall 132 may be arranged generally vertically and transversely, i.e. along a y-z plane, as shown. In turn, the front and rear top walls 128 and 130 may be planar, parallel to one another, and preferably horizontal, i.e. arranged in respective x-y planes. Furthermore, the main body 110 may include a rear wall 134, provided at a rear end of the rear portion 114 of the main body 110. The rear wall 134 may be planar and generally vertical and transverse, i.e. arranged along a y-z plane and parallel to the transition wall 132, as shown. The interior space 116 may be defined between the left side wall 120, right side wall 122, bottom wall 124, top wall 126, and rear wall 134.

As shown in FIG. 1, the shape of storage box assembly 100, and more specifically, of the main body 110, is oblong, having a narrower than tall aspect ratio. However, in other embodiments, the storage box assembly 100 may be any aspect ratio and any polygonal shape.

Figure 2:
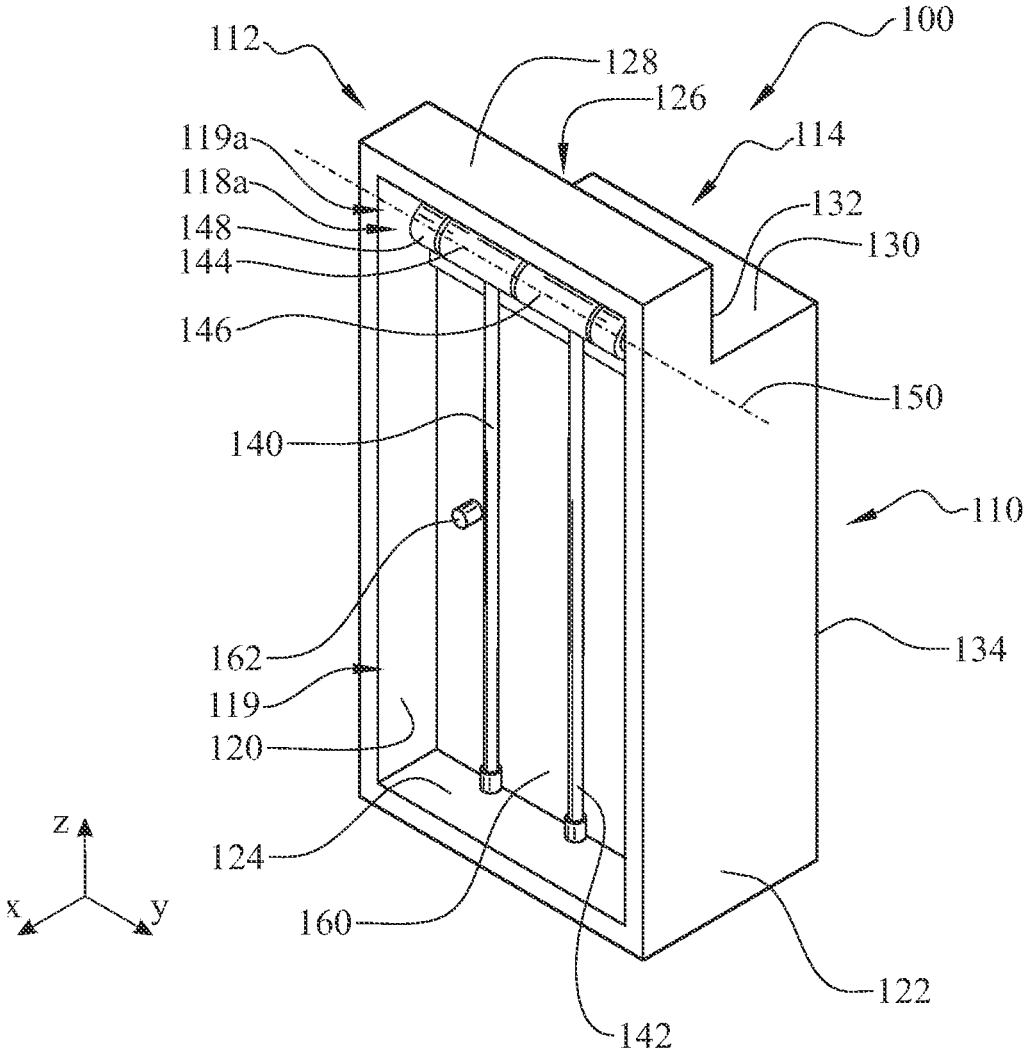
FIG. 2 presents a top, front right side isometric view of the storage box assembly, similar to FIG. 1, with the rods shown in a lowered, suspended position and the door shown in a closed position.
Figure 5:
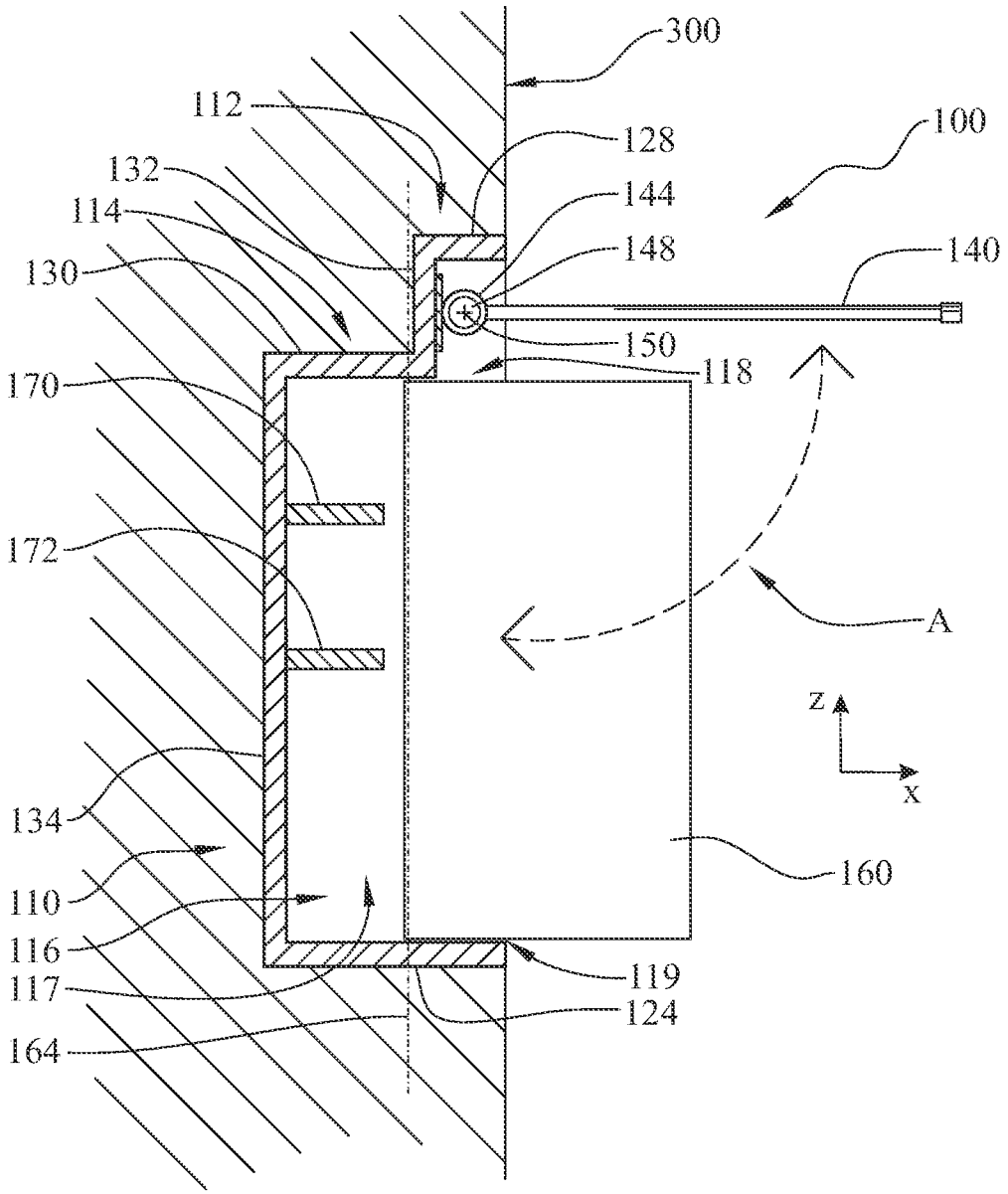
FIG. 5 presents a cross-sectional, left side elevation view of the storage box assembly built into the wall of FIG. 2, with the door shown in an open position.

The storage box assembly 100 may further include one or more rods 140, 142 and one or more hinges 144, 146 enabling rotation of the one or more rods 140, 142 with respect to the main body 110. The one or more hinges 144, 146 may be mounted on a shaft 148, which may extend from and between the left side wall 120 and the right side wall 122 of the main body 110. In some embodiments, the one or more rods 140, 142 may include a plurality of rods 140, 142, as shown, which may be parallel to one another, i.e. arranged in non-converging, non-diverging, or non-intersecting directions. In some embodiments, each rod 140, 142 may be rotatable by a respective one of the hinges 140, 142, preferably independently from the remaining rod or rods 140, 142. For example, in the present embodiment, a first rod 140 is rotatable by a first hinge 144, and a second rod 142 is rotatable by a second hinge 146. The one or more rods 140, 142 may rotate about respective, one or more rod rotation axes 150, which may be the same or different; for example, the rods 140, 142 of the present embodiment are rotatable about a common rotation axis 150, as indicated in FIG. 5 by arrow A. The rod rotation axis or axes 150 of the one or more rods 140, 142 may be horizontal, such as arranged in the left-to-right, transverse direction y, as shown. As shown in FIGS. 1 and 2, where the one or more rods 140, 142 specifically include a plurality (e.g., pair) of rods 140, 142, each rod 140 and 142 may rotate along a respective rotation plane, and the rotation planes may be parallel to each other. For example, the first rod 140 rotates along a first, vertical and longitudinal, x-z plane, and the second rod 142 rotates along a second, vertical and longitudinal, x-z plane which is arranged rightward of and parallel to the first plane.

Figure 6:
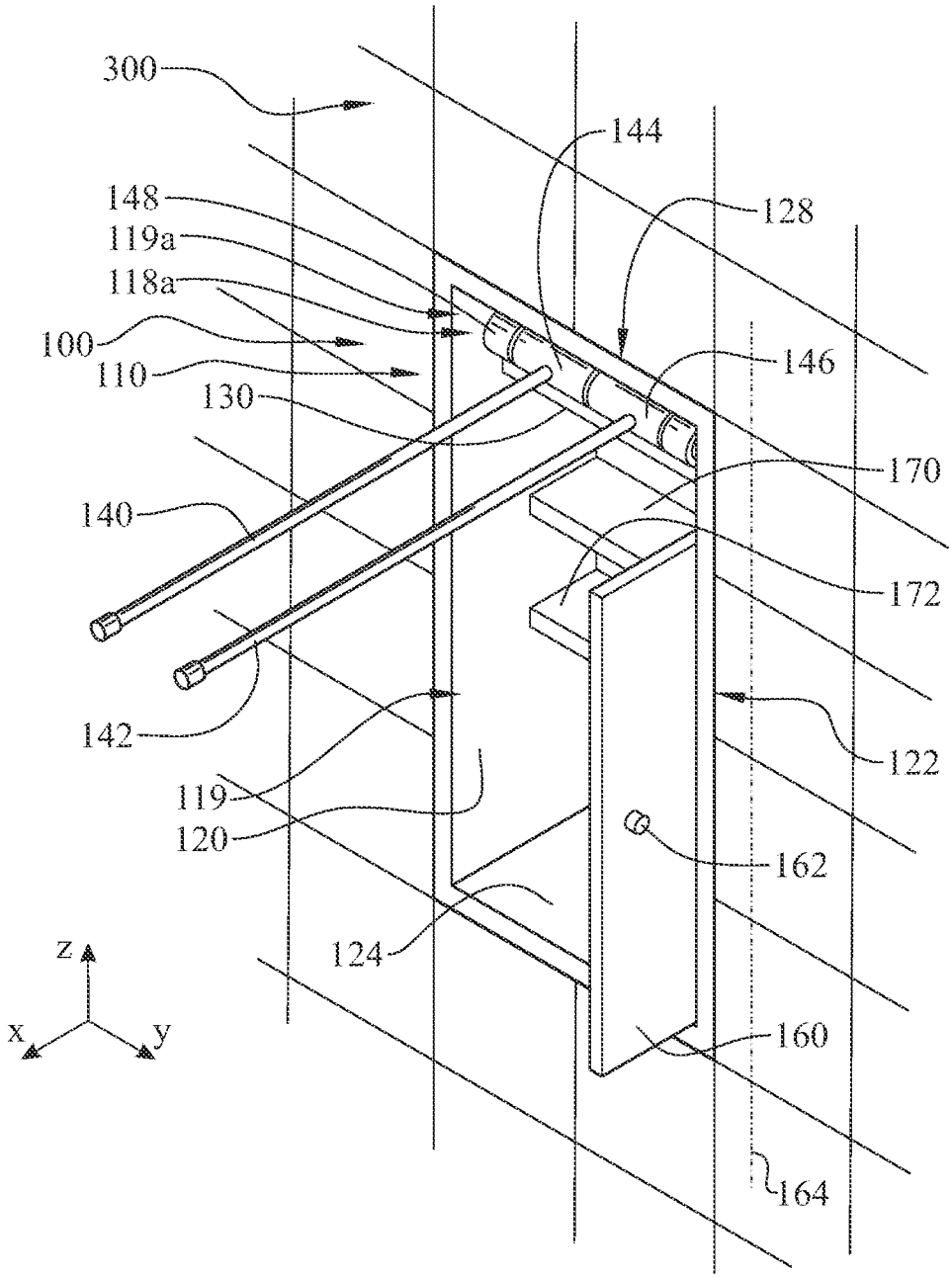
FIG. 6 presents a top, front right side isometric view of the storage box assembly built into the wall of FIG. 2, with the rods shown extended and the door shown in the open position.

The storage box assembly 100 may further include a door 160. A knob 162 may be formed in or affixed to the door 160, facilitating a manual opening and/or closing of the door 160 by an individual. The door 160 may be pivotable about a door rotation axis 164 between a closed position (FIGS. 1-4) and an open position (FIGS. 5 and 6). In some embodiments, the door rotation axis 164 may be generally perpendicular to the rod rotation axis 150; for example the door rotation axis 164 of the present embodiment is vertical. Alternatively or additionally, the door rotation axis 164 may be arranged adjacent to one of the left side wall 120 and the right side wall 122. For instance, the door rotation axis 164 of the present embodiment is vertical and adjacent to the right side wall 106 of the main body 110. In some embodiments, the rod rotation axis 150 may be arranged frontward of the door 160 in the closed position.

The door 160 is configured such that, when arranged in the closed position (FIGS. 1-4), the door 160 closes off a rear area 117 of the interior space 116 of the main body 110 of the storage box assembly 100, the rear area 117 encompassed by the left and right side walls 120, 122, the bottom wall 124, the top wall 126, the door 160 itself, and the rear wall 134. Preferably, the closed door 160 may be arranged in substantial vertical alignment with the transition wall 132, such that the rear area 117 is more specifically defined by the rear top wall 130 of the top wall 126, as best shown in FIG. 4, and such that the door 160 thereby encloses the rear portion 114 of the main body 110. With the door 160 arranged in the closed position, a remainder of the interior space 116, hereinafter referred to as front area 118 of the interior space 116, is arranged frontward of the door 160, preferably at the front portion 112 of the main body 110. The front area 118 may be defined by the left and right side walls 120, 122, the bottom wall 124, the transition wall 132, the front top wall 128, and the door 160 itself. The front area 118 is in spatial communication and accessible through the front opening 119.

In the present embodiment, as shown for instance in FIG. 1, the front area 118 of the interior space 116 is wider than the rear area 117 of the interior space 116 and extends laterally beyond the rear area 117. More specifically, the front area 118 includes an offset section 118*a* which extends beyond the rear area 117 towards a side of the main body 110. Similarly, the front opening 119 includes an offset section 119*a* which extends beyond the rear area 117 towards the same side of the main body 110 as the offset section 118*a* of the front area 118. For example, in the present embodiment, the offset sections 118*a* and 119*a* of the front area 118 and the front opening 119, respectively, extend towards a top side of the main body 110. The offset section 119*a* of the front opening 119 is arranged frontward of and provides access to the offset section 118*a* of the front area 118.

Figure 3:
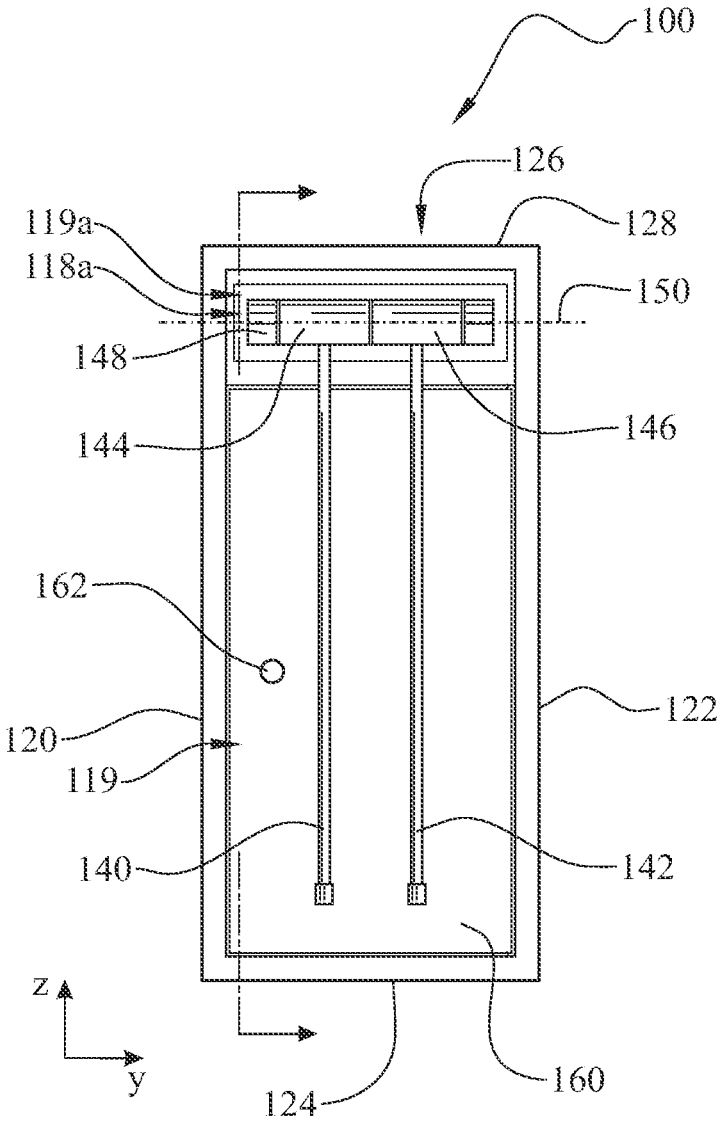
FIG. 3 presents a front elevation view of the storage box assembly of FIG. 2.
Figure 4:
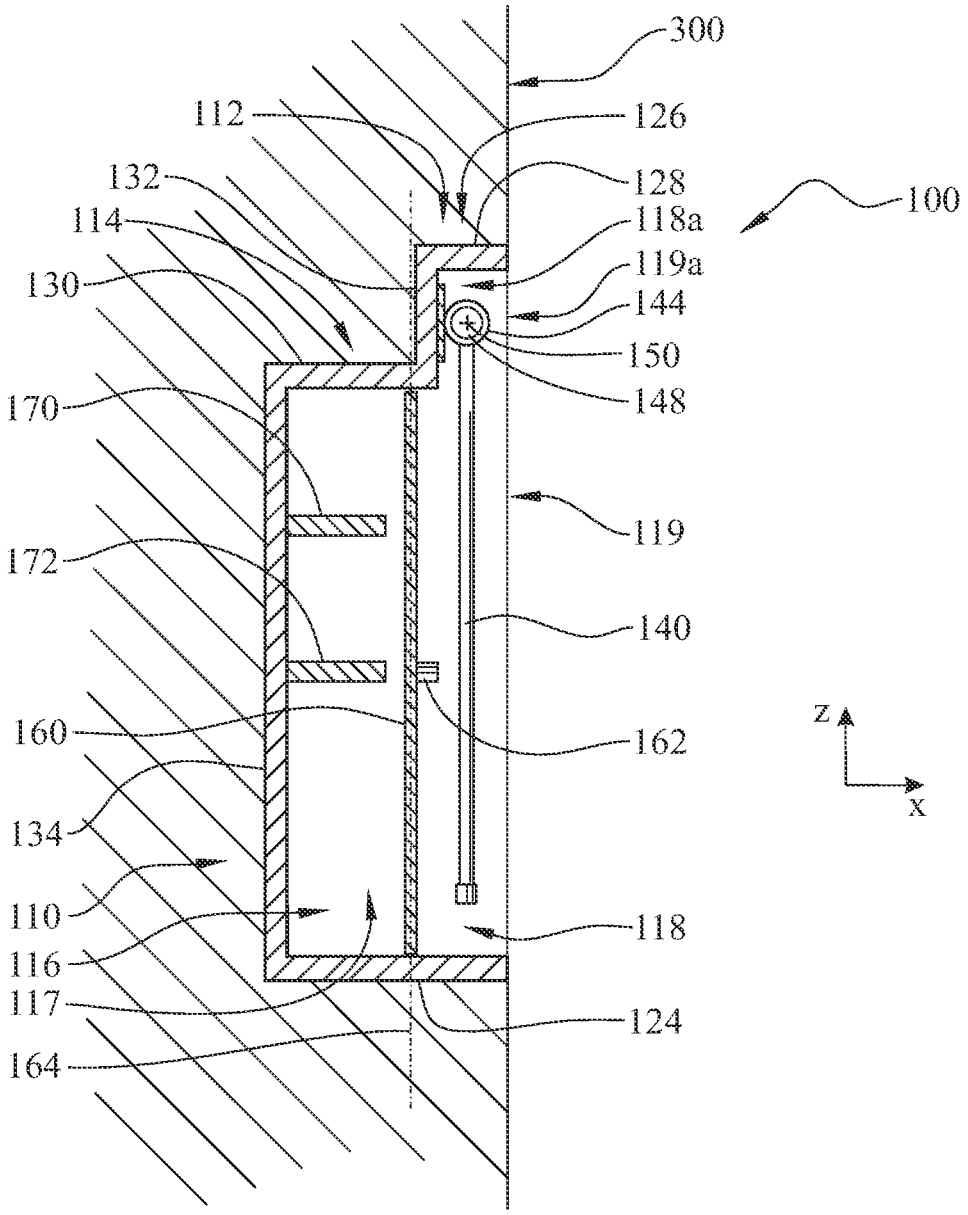
FIG. 4 presents a cross-sectional, left side elevation view of the storage box assembly of FIG. 2, shown built into a wall in accordance with an embodiment of the present invention.

As best shown in FIGS. 3 and 4, the door 160 may be arranged vertically lower than the one or more hinges 144, 146 and the shaft 148. For example, in the present embodiment, the one or more hinges 144, 146 and the shaft 148 are arranged higher than, vertically spaced-apart with, and frontward of a top edge of the door 160. More specifically, the rod rotation axis 150, and more preferably, as shown, the one or more hinges 144, 146 and the shaft 148, may be arranged entirely within and along the offset section 118*a* of the front area 118 of the interior space 116. As best shown in FIG. 4, the rods 140, 142 may be pivoted to a lowered position in which the rods 140, 142 are suspended in front of the closed door 160, within the front area 118 of the interior space 116, and optionally spaced-apart from the closed door 160. As shown, the one or more hinges 144, 146 and the shaft 148 may be arranged at an intermediate area or top area of the transition wall 132 such that, in the suspended configuration of the rods 140, 142 (FIG. 4), the transition wall 132 may prevent a further pivoting of the rods 140, 142 towards the closed door 160. Alternatively or additionally, said further pivoting may be prevented by the one or more hinges 144, 146.

With reference to FIGS. 1 and 4, the closed door 160 may provide physical security for one or more items stored in the rear area 117 of the interior space 116, particularly when the storage box assembly 100 is installed in a room of vehicle, such as bus, train, airplane, boat, or ship, which can move such that one or more items stored in the rear portion are shifted. In some embodiments, when arranged in the closed position, the door 160 may additionally be locked to allow only users, authorized to access the one or more items to unlock the door. In some embodiments, the door 160 may be transparent or variably translucent across the surface of door 160 sufficient for an individual looking at storage box assembly 100 to identify any of the one or more items; alternatively or additionally, the door 160 may be fitted with open regions or small windows. Alternatively, the door 160 may be opaque to prevent an individual from seeing what the items are when door 160 is closed. An opaque door 160 maintains the confidentiality of the one or more kinds of the one or more items. Correspondingly, privacy of one or more users of any of the one or more items behind the one or more doors may be ensured. If the door 160 is locked, physical security, confidentiality, and privacy may be enhanced. Although FIG. 1 shows one door 160, storage box assembly 100 may include multiple doors closing multiple compartments.

The illustration of FIG. 1 additionally depicts the one or more rods 140, 142 raised upward along a lateral (pitch) angular direction in concert with hinges 144, 146 about the shaft 148 and the rod rotation axis 150. Although the figures illustrate two rods 140, 142 and two hinges 144, 146, the storage box assembly 100 may have any number of rods and hinges. For example, as mentioned heretofore, in some embodiments, one or more rods may be attached to a single hinge. The illustration of FIG. 1 shows the one or more rods 140, 142 pivotally raised to a position perpendicular to and extending frontward with respect to the door 160. In this position, the one or more rods 140, 142 extend frontward across the front area 118 of the interior space 116, and further outward and frontward of the main body 110. When the storage box assembly 100 is installed in a wall (not shown), the one or more rods 140, 142 would be raised to a position perpendicular with the surface of the wall. In this position, the one or more rods 140, 142 may be used for hanging items related to the purpose of storage box assembly 160. For example, when the storage box assembly 100 is installed in a bathroom, any of one or more towels, washcloths, hand towels, and other bathroom linens may be hung from the extended, one or more rods 140, 142 for easy access and drying. In some embodiments, the one or more rods 140, 142 may be fitted with tapered ends to prevent one or more items hung on one or more rods 140, 142 from falling off an end, particularly in the case of storage box assembly 100 installed in a wall of a room in a vehicle (not shown). Correspondingly, soaps, lotions, shampoo, condition, shaving cream, razors, and similar grooming items may be stored in the rear portion.

Alternatively, when the storage box assembly 100 is intended for first aid items, any of one or more bandages, dressings, tape, cast materials may be hung from the one or more rods 140, 142 for ready access in anticipation of an imminent emergency. The rear area 117 of the interior space 116, behind the door 160, may store first aid remedies, ointments, disinfectants, pain relievers, and the like.

With reference to FIG. 2, the storage box assembly 100 is illustrated with the one or more rods 140, 142 pivotally lowered about the rod rotation axis 150 to the lowered, suspended position in which the one or more rods 140, 142 are parallel with the surface of the door 160. The user may choose to position the one or more rods 140, 142 in this lowered position when the one or more rods 140, 142 are not needed. With the one or more rods 140, 142 in the lowered, suspended position, the one or more rods 140, 142 are stored out of the way, such that they no longer protrude outward (frontward) of the main body 110 and therefore no longer occupy the space in front of the storage box assembly 100, allowing said space to be utilized in other ways, particularly if space is limited as in the situation of storage box assembly 100 installed in a small room. As shown in FIG. 2, the knob 162 may be positioned behind the one or more rods 140, 142, and offset the one or more rods 140, 142 (e.g., displaced left of rod 140). In some embodiments, the door 160 may be configured to slide open to the right projecting out through an opening (not shown) through the right side wall 122; in such embodiments, the knob 162 would pass behind one or more rods 140, 142 as door 160 slides to the right to open.

The illustration of FIG. 3 shows a front elevation view of the storage box assembly 100. As shown, the shaft 148 is attached to rear of the front portion 112 left of the first hinge 144 and right of the second hinge 146. In some embodiments, arrows in FIG. 3 indicate door 160 configured to slide right through an opening (not shown) in side wall 122 to provide access to the rear portion of storage box assembly 100 where one or more items may be stored. Additionally, arrows in FIG. 3 indicate the cross-section plane corresponding to the cross-sectional, left side elevation view of FIG. 4.

With reference to FIG. 4, the storage box assembly 100 is illustrated built into wall 300. In some embodiments, the storage box assembly 100 may include or more shelves 170, 172. The one or more shelves 170, 172 may be positioned within the rear area 117 of the interior space 116. For example, the rear portion 114 of the main body 110 of the storage box assembly 100 of the present embodiment includes an upper shelf 170 and a lower shelf 172. The shelves 170, 172 are attached to the rear wall 134 and extend into the rear area 117 of the interior space 116, behind the door 160. In the present embodiment, a front ends or edges of the bottom wall 124 and the front top wall 128 are flush with the surface of wall 300. Similarly, as shown in FIG. 6, front ends or edges of the left and right side walls 120, 122 may also be configured to be flush with the surface of wall 300. As further shown in FIG. 4, the shaft 148 may be attached to the transition wall 132 at the rear of the front portion 112 of the main body 110. Alternatively, the shaft 148 may be attached to the left and right side walls 120, 122.

As an alternative or in addition to upper shelf 170 and lower shelf 172, the storage box assembly 100 may include one or more compartments (not shown). A compartment may have one or more doors that open for access to the compartment. The one or more doors may be locked to allow only one or more authorized users access to the compartments or one or more sections of the compartments to which the one or more doors open. The one or more doors to the one or more compartments may be transparent to allow individuals to identify what items are stored in the compartment. Alternatively, the one or more doors to the one or more compartments may be translucent such that an individual may inspect that there are one or more items in the compartment, but not identify the one or more items. Thirdly, the one or more doors to the one or more compartments may be opaque to maintain the confidentiality of the one or more kinds of the one or more items are stored in the one or more compartments. This arrangement, in turn, protects the privacy of the one or more authorized users of the one or more items, particularly, if the one or more doors are locked.

Turning to FIG. 5, the one or more rods 140, 142 are shown pivotally raised about the rod rotation axis 150 to the raised, extended position in which the one or more rods 140, 142 extend across the front area 118 of the interior space 116, and outward and frontward of the main body 110. In the raised, extended position, the one or more rods 140, 142 may be arranged perpendicular with the surface of wall 300. With the one or more rods 140, 142 raised, any of one or more towels, cloth items, or other items may be hung on the one or more rods 140, 142 as heretofore described. With the one or more rods 140, 142 raised, the door 160 may be pivotally opened and closed. For example, the illustration of FIG. 5 illustrates the door 160 in the open position. When the door 160 is open, one or more items located in rear portion 114 of the storage box assembly 100, and more specifically in the rear area 117, such as on the upper shelf 170 or lower shelf 172, may be accessed, and/or one or more items may be placed in the rear area 117, such as on the shelves 170, 172.

One or more doors of the one or more compartments may have various configurations. For example, the one or more doors of the one or more compartments may open on a side like door 160 along an axial (yaw) angular direction or on a top or bottom along a lateral pitch angular direction. Alternatively, the one or more doors of the one or more compartments may be folded open toward the left side wall 120, the right side wall 122, the bottom wall 124, or the rear top wall 130. Thirdly, if adjacent to the left side wall 120, the right side wall 122, the bottom wall 124, or the rear top wall 130, the one or more doors of the one or more compartments may open by sliding through a slot (not shown) in the left side wall 120, the right side wall 122, the bottom wall 124, or the rear top wall 130. The one or more doors of the one or more compartments may have one or knobs, such as similarly to knob 162, for manual opening of the one or more doors of the one or more compartments.

The illustration of FIG. 6 shows the one or more rods 140, 142 pivoted to the raised, extended position, which may be perpendicular with the surface of wall 300. As shown, the shaft 148 may be attached to the left and right sides 120 and 122 at the back of the front portion 112 of the main body 110 at one area to the left hinge 144 and at another area to the right of hinge 146. As depicted, when the door 160 is completely open, the door 160 is flush with the surface of the right side wall 122. One or more items may be placed on the surface of bottom wall 124. In the present embodiment, said one or more items on the surface of bottom wall 124 in the front portion of storage box assembly 100 must be moved when door 160 is opened. One or more items may be placed on upper shelf 170 and lower shelf 172. When the one or more rods 140, 142 are raised, any of one or more towels, cloth items, and other items may be hung on one or more rods 140, 142, as heretofore described. Once the storage box assembly 100 is no longer to be used to suspend items and/or to access the rear area 117 of the interior space 116, the door 160 may be closed and the one or more rods 140, 142 pivoted to the retracted position, as shown in FIGS. 2 and 4; in this configuration, a frontmost edge of the storage box assembly 100, said frontmost edge provided by the frontmost edge of the main body 110 (i.e. by the front edges of the left side wall 120, bottom wall 124, right side wall 122, and front top wall 128) is coplanar and preferably flush with the wall 300.

Figure 7:
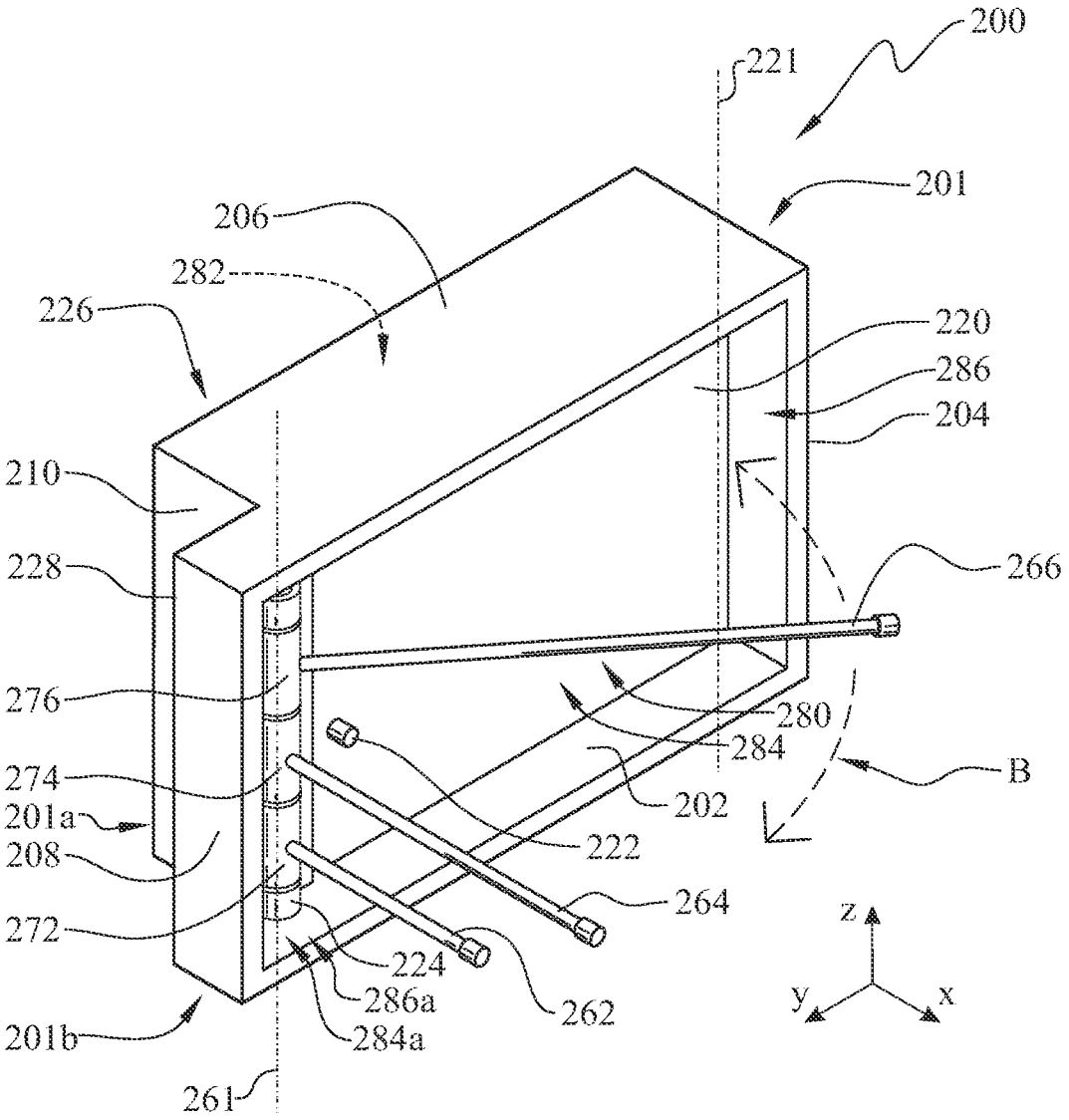
FIG. 7 presents a top, front left side isometric view of a storage box assembly in accordance with a further embodiment of the present invention.

The illustration of FIG. 7 shows an alternative embodiment of a storage box assembly 200. As shown, the shape of a main body 201 of the storage box assembly 200 is oblong with a wider than tall aspect ratio. The main body 201 includes a rear portion 201*a* and a front portion 201*b*. The main body 201 of the storage box assembly 200 includes a bottom wall 202, a right side wall 204, a top wall 206, a left side wall 208 of the front portion 201*b*, a left side wall 210 of the rear portion 201*a*, a rear wall 226 of the rear portion 201*a*, a rear wall 228 of the front portion 201*b* (said rear wall 228 serving as a transition wall between the left side walls 208 and 210), one or more rods 262, 264, 266, one or more hinges 272, 274, 276 enabling rotation of the one or more rods 262, 264, 266 about a rod rotation axis 261, a door 220, a knob 222, and a shaft 224. Similarly to the previous embodiment, the main body 201 is hollow and defines an interior space 280. The main body 201 ends in a front opening 286, arranged frontward of and providing access to the interior space 280. The door 220 is configured to close off a rear area 282 of the interior space 280 of the main body 201 of the storage box assembly 200, the rear area 282 encompassed by the right side wall 204, the left side wall 210, the rear wall 226 of the rear portion 201*a*, the bottom wall 202, the top wall 206, and the closed door 220. A remaining, front area 284 of the interior space 280 of the main body 201 of the storage box assembly 200 is arranged frontward of the closed door 220 and is arranged at the front portion 201*b*. The front area 284 is in spatial communication and accessible through the front opening 286. The knob 222 is configured for an individual to open door 220 manually. The door 220 extends from the right side wall 204 to the bottom wall 202. The door 220 is arranged rightward of the shaft 224 and rightward of the one or more hinges 272, 274, 276 (i.e. the shaft 224 and the one or more hinges 272, 274, 276 are offset relative to the door 220 towards the left side of the main body 110). The front area 284 of the interior space 280, which is arranged frontward of the closed door 220, is encompassed by the right side wall 204, the left side wall 208 of the front portion 201*b*, the bottom wall 202, the top wall 206, the closed door 220, and the rear wall 228 of the front portion 201*b*. The door 220 may be pivotably connected to the main body 201, such as by a hinge, at the right side wall 204, about a preferably vertical door rotation axis 221. The door rotation axis 221 may be parallel to the rod rotation axis 261. The door 220 may be configured to open out by rotating about its right edge in an axial (yaw) angular direction. Alternatively, the door 220 may be configured to slide through an opening in the right side wall 204 (not shown). The rod rotation axis 261 may be arranged frontward of the door 200 in the closed position.

Similarly to the previous embodiment, the front area 284 of the interior space 280 is wider than the rear area 282 of the interior space 280 and extends laterally beyond the rear area 282. More specifically, the front area 284 includes an offset section 284*a* which extends beyond the rear area 282 towards a side of the main body 201. Similarly, the front opening 286 includes an offset section 286*a* which extends beyond the rear area 282 towards the same side of the main body 201 as the offset section 284*a* of the front area 284. For example, in the present embodiment, the offset sections 284*a* and 286*a* of the front area 284 and the front opening 286, respectively, extend towards a left side of the main body 110. The offset section 286*a* of the front opening 286 is arranged frontward of and provides access to the offset section 284*a* of the front area 284. The rod rotation axis 261, and more preferably, as shown, the hinges 272, 274, 276 and the shaft 224, may be arranged entirely within and along the offset section 284*a* of the front area 284 of the interior space 280.

Similarly to the previous embodiment, each rod 262, 264, 266 is rotatable along a respective rotation plane, and these rotation planes may be parallel to each other. For example, rod 262 rotates along a first, horizontal, x-y plane, rod 264 rotates along a parallel, second, horizontal, and slightly higher x-y plane, and rod 266 rotates along a parallel, third, horizontal, and even higher x-y plane. The illustration of FIG. 7 moreover shows rods 262, 264, 266 independently adjusted at different angles about shaft 224 on hinges 272, 274, 276, respectively, in axial (yaw) angular direction as indicated by arrow B. This arrangement allows for items to be hung on different rods without the items getting into the way of one another. The shaft 224 may be attached to rear of the front portion 228 below the hinge 272 and above hinge 276. Alternatively, shaft 224 may be attached to the bottom wall 202 and the top wall 206.

Similarly to the previous embodiment, the rods 262, 264, 266 may be pivoted to extended positions in order to suspend items therefrom and/or allow the door 220 to be opened or closed to allow or prevent access to the rear area 282 of the interior space 280, respectively. Once the storage box assembly 200 is no longer to be used to suspend items and/or to access the rear area 282 of the interior space 280, the door 220 may be closed and the rods 262, 264, 266 pivoted to the retracted position, in which the rods 262, 264, 266 are arranged within the front area 284 of the interior space 280 and do not protrude outward (frontward) of the main body 110; in this configuration, a frontmost edge of the storage box assembly 200, said frontmost edge provided by the frontmost edge of the main body 201 (i.e. by the front edges of the left side wall 208, bottom wall 202, right side wall 204, and top wall 206) is coplanar and preferably mountable in flush relationship with a wall 300 (FIG. 5), similarly to the previous embodiment.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A storage box assembly, comprising:

a hollow, main body, comprising a front opening providing access to an interior space, the interior space comprising a rear area and a front area wherein an offset section of the front area extends beyond the rear area towards a side of the main body;

a door, movably carried by the main body and selectively movable with respect to the main body between:

a closed position, in which the door extends across the interior space of the main body and separates the rear area of the interior space from the front area of the interior space, the front area accessible through the front opening of the main body, and an open position, in which the door allows access to the rear area of the interior space through the front opening and the front area of the interior space; and one or more rods, pivotably carried by the main body, the one or more rods pivotable with respect to the main body about a rod rotation axis arranged along said offset section of the front area, the one or more rods selectively pivotable with respect to the main body between:

a retracted position, in which the one or more rods are arranged within the front area of the interior space and do not extend outward of the main body through the front opening, and an extended position, in which the one or more rods extend outward of the main body through the front opening enabling the hanging thereon of one or more items.

2. The storage box assembly of claim 1, wherein the door in the closed position is perpendicular to the one or more rods in the extended position.

3. The storage box assembly of claim 1, wherein the door is pivotably movable with respect to the main body about a door rotation axis.

4. The storage box assembly of claim 3, wherein the door rotation axis is vertical.

5. The storage box assembly of claim 4, wherein the door rotation axis is arranged at one of a left side wall or a right side wall of the main body.

6. The storage box assembly of claim 3, wherein the rod rotation axis is parallel to the door rotation axis.

7. The storage box assembly of claim 3, wherein the rod rotation axis is perpendicular to the door rotation axis.

8. The storage box assembly of claim 3, wherein, with the door arranged in the closed position and the one or more rods arranged in the retracted position, the one or more rods block the door from pivoting from the closed position to the open position.

9. The storage box assembly of claim 8, wherein the door is pivotably movable between the open and closed positions with the one or more rods arranged in the extended position.

10. The storage box assembly of claim 1, wherein the one or more rods comprise a plurality of rods.

11. The storage box assembly of claim 10, wherein the plurality of rods are independently pivotable relative to each other with respect to the main body.

12. The storage box assembly of claim 10, wherein each rod the plurality of rods is pivotable along a respective rotation plane, and further wherein the rotation planes of the plurality of rods are parallel to one another.

13. The storage box assembly of claim 12, wherein the plurality of rods are pivotable about a common, rod rotation axis.

14. The storage box assembly of claim 10, wherein the plurality of rods in the extended position are parallel to one another.

15. The storage box assembly of claim 1, wherein the rod rotation axis is arranged frontward of the door in the closed position.

16. The storage box assembly of claim 1, wherein the front opening comprises an offset section arranged frontward of and providing access to the offset section of the front area, and further wherein the one or more rods in the extended position extend outward of the main body through said offset section of the front opening.

17. The storage box assembly of claim 1, wherein, with the door arranged in the closed position and the one or more rods arranged in the retracted position, a frontmost edge of the storage box assembly is provided by a coplanar, front edge of the main body.

18. A storage box assembly, comprising:

a hollow, main body, comprising a front opening providing access to an interior space, the interior space comprising a rear area and a front area, the front area arranged frontward of the rear area and in spatial communication with the front opening, the front area comprising an offset section extending beyond the rear area towards a side of the main body, and the front opening comprising an offset section arranged frontward of and providing access to the offset section of the front area;

a door, pivotably carried by the main body and selectively pivotable with respect to the main body between:

a closed position, in which the door extends across the interior space of the main body and separates the rear area of the interior space from the front area of the interior space, the front area accessible through the front opening of the main body, and an open position, in which the door allows access to the rear area of the interior space through the front opening and the front area of the interior space; and one or more rods, pivotably carried by the main body and pivotable about a rod rotation axis, the rod rotation axis arranged along the offset section of the front area, the one or more rods selectively pivotable with respect to the main body between:

a retracted position, in which the one or more rods are arranged within the front area of the interior space and do not extend outward of the main body through the front opening, and an extended position, in which the one or more rods extend outward of the main body through the offset section of the front opening enabling the hanging thereon of one or more items; wherein with the door arranged in the closed position and the one or more rods arranged in the retracted position, the one or more rods block the door from pivoting from the closed position to the open position.

19. A storage box assembly, comprising:

a hollow, main body, comprising a front opening providing access to an interior space;

a door, pivotably carried by the main body and selectively pivotable about a door rotation axis and with respect to the main body between:

a closed position, in which the door extends across the interior space of the main body and separates a rear area of the interior space from a front area of the interior space, the front area accessible through the front opening of the main body, and an open position, in which the door allows access to the rear area of the interior space through the front opening and the front area of the interior space; and one or more rods, pivotably carried by the main body, the one or more rods pivotable with respect to the main body about a rod rotation axis parallel to the door rotation axis, the one or more rods selectively pivotable with respect to the main body between:

a retracted position, in which the one or more rods are arranged within the front area of the interior space and do not extend outward of the main body through the front opening, and an extended position, in which the one or more rods extend outward of the main body through the front opening enabling the hanging thereon of one or more items.

20. A storage box assembly, comprising:

a hollow, main body, comprising a front opening providing access to an interior space;

a door, pivotably carried by the main body and selectively pivotable about a door rotation axis and with respect to the main body between:

a closed position, in which the door extends across the interior space of the main body and separates a rear area of the interior space from a front area of the interior space, the front area accessible through the front opening of the main body, and an open position, in which the door allows access to the rear area of the interior space through the front opening and the front area of the interior space; and one or more rods, pivotably carried by the main body, the one or more rods selectively pivotable with respect to the main body between:

a retracted position, in which the one or more rods are arranged within the front area of the interior space and do not extend outward of the main body through the front opening, and an extended position, in which the one or more rods extend outward of the main body through the front opening enabling the hanging thereon of one or more items; wherein with the door arranged in the closed position and the one or more rods arranged in the retracted position, the one or more rods block the door from pivoting from the closed position to the open position; and further wherein the door is pivotably movable between the open and closed positions with the one or more rods arranged in the extended position.

21. A storage box assembly, comprising:

a hollow, main body, comprising a front opening providing access to an interior space;

a door, movably carried by the main body and selectively movable with respect to the main body between:

a closed position, in which the door extends across the interior space of the main body and separates a rear area of the interior space from a front area of the interior space, the front area accessible through the front opening of the main body, and an open position, in which the door allows access to the rear area of the interior space through the front opening and the front area of the interior space; and one or more rods, pivotably carried by the main body, the one or more rods selectively pivotable with respect to the main body between:

a retracted position, in which the one or more rods are arranged within the front area of the interior space and do not extend outward of the main body through the front opening, and an extended position, in which the one or more rods extend outward of the main body through the front opening enabling the hanging thereon of one or more items; wherein with the door arranged in the closed position and the one or more rods arranged in the retracted position, a frontmost edge of the storage box assembly is provided by a coplanar, front edge of the main body.

* * * * *